United States Patent [19]

Korn

[11] 4,064,433

[45] Dec. 20, 1977

[54] PRISMATIC LIGHTING PANEL

[75] Inventor: William W. Korn, Kirkwood, Mo.

[73] Assignee: K-S-H, Inc., St. Louis, Mo.

[21] Appl. No.: 701,229

[22] Filed: June 30, 1976

[51] Int. Cl.[2] ..... F21V 5/00

[52] U.S. Cl. ..... 362/330; 350/259

[58] Field of Search ..... 350/259; 240/106 R, 240/41.4 D, 92

[56] References Cited

U.S. PATENT DOCUMENTS

| | | | |
|---|---|---|---|
| 3,038,065 | 6/1962 | Franck et al. | 240/106 |
| 3,213,751 | 10/1965 | Benjamin et al. | 350/259 |
| 3,829,680 | 8/1974 | Jones | 240/106 |

*Primary Examiner*—Richard A. Wintercorn

*Attorney, Agent, or Firm*—Polster, Polster and Lucchesi

[57] ABSTRACT

A light-weight plastic lighting panel having recessed conical prisms arranged in such a way that their intersecting edges form equilateral triangles, all of whose sides lie along lattice lines. The side of each triangle has a length of 0.475 cm. (three-sixteenths of an inch), and the panel may have a weight of less than 1600 grams per square meter (5.2 ounces/square foot).

10 Claims, 4 Drawing Figures

FIG.2.
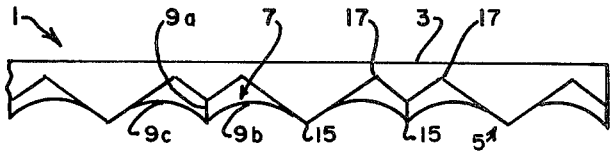
FIG.1.
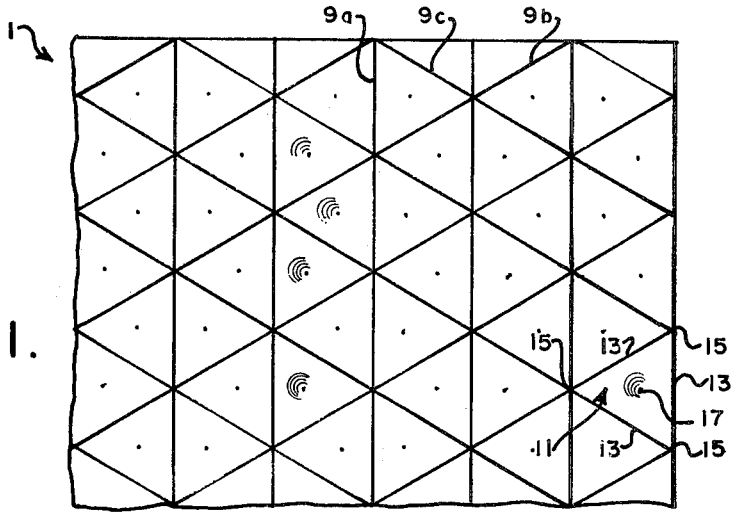
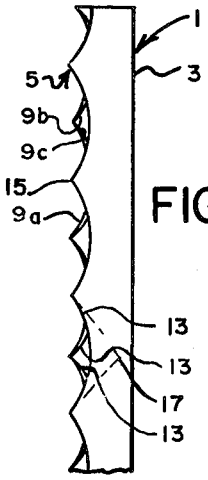
FIG.3.
FIG.4.
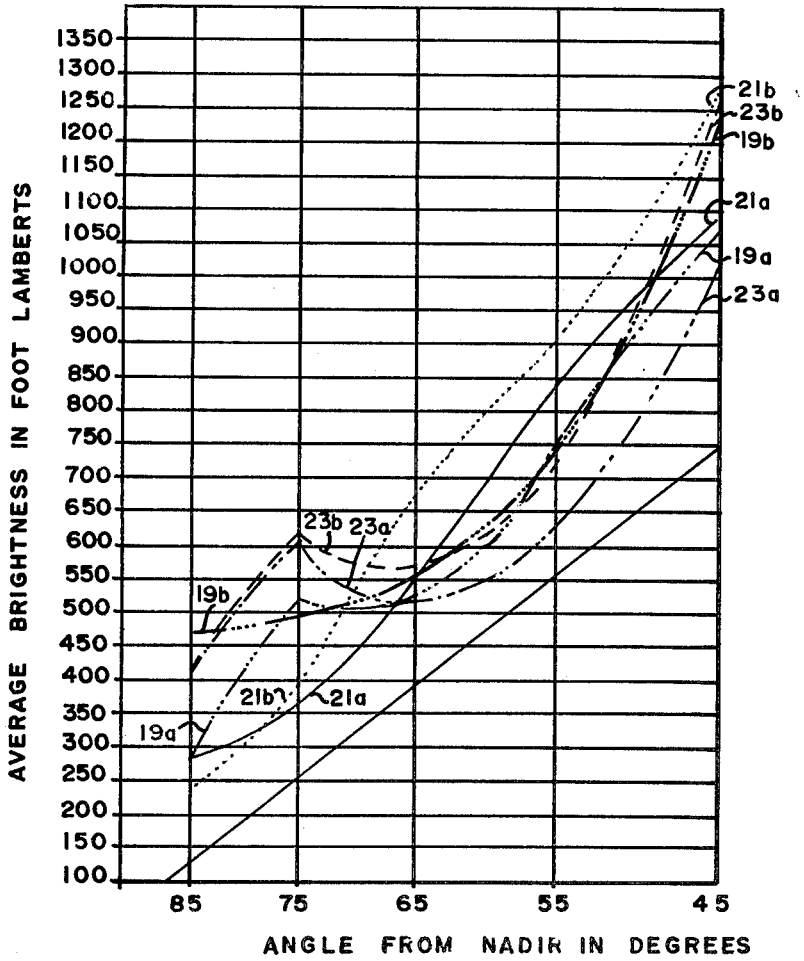

PRISMATIC LIGHTING PANEL

BACKGROUND OF THE INVENTION

This invention relates to prismatic lighting panels, and in particular to a light-weight plastic lighting panel used for the distribution of light from a light source. Prismatic lighting panels are widely used in overhead fluorescent lighting fixtures, and may be used with other light sources. Their primary purpose is to reduce direct glare by controlling the angle at which light emerges from the panel.

The theory of prismatic lighting panels is well known, and is discussed, for example, in McPhail, U.S. Pat. No. 2,474,317. Such panels include a planar upper face and a lower face covered with prismatic elements. Light rays entering the top of the panel are either refracted downward through the lower surface of the panel at useful angles to the vertical (i.e. the normal of the panel), or are reflected internally by the prismatic elements upward through the upper surface of the panel. If the prismatic elements have straight sides which make the proper angle with the normal of the panel, virtualy all of the light which would otherwise emerge at high angles relative to the normal of the panel is internally reflected by the prisms and high angle "direct" glare is thereby greatly reduced or eliminated.

A particularly popular prismatic lighting panel has, on its lower surface, female conical prisms, the apexes of which are aligned along 45° diagonals to the edges of the panel and spaced three-sixteenths of an inch (0.50 ± 0.05 centimeters) on centers. The intersections of the cones thus form a structure of square cells, all of whose sides lie along lattice lines running at angles of 45° to the edges of the panel. An example of such a lighting panel is one sold by K-S-H, Inc., under the trademark KSH-12. For convenience, a panel having this pattern will be referred to herein as "the usual" panel.

In recent years there has been an increasing demand for inexpensive prismatic lighting panels. Because the plastic material of which the panels are made represents the major cost of prismatic lighting panels, the usual prismatic panel has been made ever thinner, until presently it has reached the limit permitted by its geometry. Because the apex angle of the female prisms is critical to the optical performance of the panel, the height of the prisms is a function of the size of the individual cells of the prismatic pattern, that is, the spacings between apexes of the cones. Although it is theoretically possible to reduce the size of the cells below the three-sixteenths inch side of the usual panel, both aesthetic considerations and manufacturing constraints have made any substantial decrease in cell size impractical. Other techniques for reducing the amount of material in a panel have been attempted, such as increasing the apex angle of the female cones or "hogging out" the prisms so that their surfaces are concave rather than linear in cross section, but these techniques yield only limited savings of material and tend to degrade the optical performance of the panel. Using presently known techniques, commercially available embodiments of the usual panel have been reduced to an overall thickness of about 0.093 inch (0.236 centimeters), and have been made as light as 5.4 ounces per square foot (1650 grams per square meter).

One of the objects of this invention is to provide a prismatic lighting panel which has optical characteristics at least comparable with those of presently known light-weight embodiments of the usual panel, and which may be made substantially lighter in weight than such panels.

Another object is to provide such a panel which resembles the usual panel in use, and which is as aesthetically pleasing as the usual panel.

Other objects will become apparent to those skilled in the art in light of the following description and accompanying drawings.

In accordance with this invention, generally stated, a prismatic lighting panel is provided having a planar upper face and prismatic lower face, the lower face defining a plurality of intersecting recessed cones having apex angles of about 116° (±10°), the apexes of the cones being spaced from each other such that the intersections of adjacent cones form sides of equilateral triangular cells arranged along lattice lines extending generally at 60° to each other. The sides are preferably about three-sixteenths inch (0.50 ± .05 cm.) long. The intersections of the lattice lines are the lowermost points of the lower face, and in the preferred embodiment the vertical distance from the apexes to a plane defined by the lowermost point is about 0.065 inch (0.17 cm.). The overall thickness of the panel may be anything greater than the height of the prisms, but is preferably from about 0.07 inch to about 0.10 inch. The panel may be formed of any transparent material, preferably a thermoplastic material such as an acrylic or light-stabilized polystyrene.

Because of the triangular configuration of the cells, the height of the prisms (i.e. the vertical distance from the apexes of the recessed cones to the plane defined by the lowermost points) is considerably less than the height of square-celled prisms having sides of the same length. Therefore, the panel of the invention may be considerably thinner and lighter than the usual panel, although both have prisms which are three-sixteenths inch on a side. For example, with an apex angle of 116°, the prisms of the present panel have a height of 0.067 inch (0.17 cm.), whereas those of the usual panel have a height of 0.084 inch (0.21 cm.). Therefore, the preferred embodient of acrylic panel of the present invention having a 0.1875 inch (0.48 cm.) cell side and a total thickness of 0.085 inch (0.22 cm.) has a "base" thickness, between the apexes of the recessed cones and the upper surface of the panel, of 0.018 inch (0.05 cm.) and weighs about 4.8 ounces per square foot (1.46 kilograms per square meter). The usual panel, with square cells of the same length side, requires a total thickness of 0.102 inch (0.26 cm.) to provide the same base thickness and would weigh about 6.2 ounces per square foot (1.89 kilograms per square meter), if the previously mentioned weight-saving techniques were not used.

The difference in weight between the usual panel and the panel of the present invention not only reflects a difference in the overall thickness of the panel required for a particular base thickness, but also indicates that the prisms of the present panel require less material for a particular prism height than do the prisms of the usual panel. Therefore, the weight advantages of the panel of this invention may be enjoyed over a considerable range of prism sizes and panel thicknesses. The use of three-sixteenths inch cell sides is preferred because it gives the panel an appearance similar to that of the usual panel. The approximately 116° apex angle is preferred because it provides superior optical characteristics. If the prism cell size is increased, the overall thickness and weight of the panel are also increased, but they may still be less than the corresponding values for the usual panel. For example, if the cell side is increased to 0.20 inch (0.05 cm.), the prism height is increased to 0.072 inch (0.18 cm.), the overall panel thickness may be 0.092 inch (0.23 cm.), and the overall weight will be about 5.1 ounces per square foot (1.47 kilograms per square meter). This is still considerably lighter than the lightest available commercial panel of the "usual" type. If the cell side is increased to 0.25 inch (0.64 cm.), the prism height is 0.090 inch (0.23 cm.); with a 0.015 inch (0.04 cm.) base thickness, the overall panel thickness will be 0.105 inch (0.27 cm.), and the panel will weigh about 5.4 ounces per square foot (1.65 kilograms per square meter). This panel is about the weight of the lightest commercially available "usual" panel, but it is considerably thicker. It also is at the upper limit of prism cell sizes which give an impression similar to that given by the usual panel. A prism cell side of about 0.017 inch (0.04 cm.) is at the lower limit of such sizes. Total thicknesses may range from about 0.07 inch (0.18 cm.) up. Cell sides of about 0.018 to about 0.020 inch (0.046–0.051 cm.) and panel thicknesses of about 0.10 inch (0.25 cm.) or less are preferred because they closely mimic the usual panel when viewed casually at a distance, and they represent an important savings of material as compared with the lightest of the usual panels.

The optical properties of the preferred embodiment of the panel of the present invention have also been found to be as good as, or somewhat better than, the optical properties of the light-weight usual panel. Of course, neither of the panels performs as well optically as the usual panel having an overall thickness of 0.12 inch (0.30 cm.).

BRIEF DESCRIPTION OF THE DRAWINGS

FIG. 1 is a bottom plan view of a fragment of the preferred embodiment of prismatic lighting panel of the present invention;

FIG. 2 is a view in front elevation, as viewed in FIG. 1, of the panel of FIG. 1;

FIG. 3 is a view in right side elevation, as viewed in FIG. 1, of the panel of FIGS. 1 and 2; and FIG. 4 is a graph showing the optical characteristics of a luminaire equipped with the panel of the present invention, as compared with the luminaire equipped with two prior art "usual" panels.

DESCRIPTION OF THE PREFERRED EMBODIMENT

Referring now to the drawings, and in partiular to FIGS. 1–3, reference numeral 1 indicates a lighting panel of the present invention. Th panel 1 is made of a transparent acrylic thermoplastic material, and has a generally planar upper face 3 and a prismatic lower face 5. The lower face 5 is composed of a set of recessed right circular cones 7 so arranged that their intersections define lattice lines 9*a*, 9*b* and 9*c* that run at 60° to each other. In a rectangular panel, such as a 2 foot by 4 foot (61 cm. by 122 cm.) panel commonly used in fluorescent lamp luminaires, one set of parallel lattice lines 9*a* preferably extends parallel to the long edges of the panel. Each recessed cone thus forms an equilateral triangular cell 11 having sides 13 defined by the intersection of that cone with three contiguous recessed cones. The sides 13 of the cells 11 (i.e. the segments of the lattice lines 9 defining each cell 11), all have a length of 0.1875 ± 0.0025 inch (0.476 ± 0.006 cm.). The intersections 15 of the lattice lines 9 lie in a common plane and are the lowest points of the panel. The apexes 17 of the recessed cones 7 are spaced 0.066 ± 0.001 inch (0.168 ± .003 cm.) above the plane defined by the intersections 15. Therefore, the apex angles of the cones 7 are 117° ± 1°. The total thickness of the panel 1, from the plane of the upper face 3 to the plane defined by the intersections 15 is 0.085 ± 0.004 inch (0.216 ± 0.010 cm.). The base thickness between the plane of the apexes 17 and the upper face 3 is about 0.015 to about 0.021 inch (0.038–0.053 cm.) because the prism depth tends to become slightly greater as the overall thickness of the panel increases. The weight of the panel is found to be about 4.4 ounces per square foot (1.34 kilograms per square meter) at the lower end of the range of panel thicknesses and about 5.1 ounces per square foot (1.56 kilograms per square meter) at the upper end.

The 0.089 inch (0.226 cm.) thick panel 1 (weighing 5.1 ounces per square foot or 1.55 kilograms per square meter) was tested for its optical properties in a standard luminaire (Recessed troffer) having four fluorescent tubes each rated at 3110 lumens and having a reflectance of 0.88. For comparison, two of the "usual" lighting panels were tested in the same fixture. Some of the results are shown in FIG. 4, where reference numerals 19*a* and 19*b* indicate curves representing average brightness at high viewing angles of the luminaire equipped with the panel 1, in a plane parallel to the lamps and in a plane perpendicular to the lamps, respectively. Reference numerals 21*a* and 21*b* indicate similar curves for the luminaire equipped with a 0.118 inch (0.30 cm.) thick "thick usual" prismatic panel (weighing 7.8 ounces per square foot or 2.38 kilograms per square meter), and reference numerals 23*a* and 23*b* indicate similar curves for the luminaire equipped with a 0.093 inch (0.24 cm.) thick "thin usual" prismatic panel (weighing 5.7 ounces per square foot or 1.74 kilograms per square meter). It will be seen that, in general, the panel 1 reduces brightness at high angles to the normal somewhat less efficiently than the thick usual prismatic panel, but slightly more efficiently than the thin usual panel, although the panel 1 weighs considerably less.

The efficiency of the panel 1 from 0° (vertical) to 60° is 54.8% (based on lamp output), the same as the efficiency of the thin usual panel and somewhat less than the 56.8% efficiency of the thick usual panel. In the 60° to 90° (horizontal) zone, where low efficiency indicates superior performance, the panel 1 has an efficiency of 7.4% as compared with 7.5% for the thin usual panel and 6% for the thick usual panel. Visual Comfort Probability, determined in accordance with the Illuminating Engineering Society procedures for a 40 foot × 60 foot × 10 foot space having 80/50/20 reflectances, yielded the following values:

| | Luminaires Lengthwise | Luminaires Crosswise |
|---|---|---|
| Panel 1 | 58 | 56 |
| Thin usual panel | 57 | 57 |
| Thick usual panel | 63 | 64 |

Numerous variations in the panel of the present invention, within the scope of the appended claims, will occur to those skilled in the art in light of the foregoing disclosure.

I claim:

1. A prismatic lighting panel for use in a lighting fixture, said panel being made of light-transmitting material and having a substantially planar upper face and a prismatic lower face, said lower face defining a plurality of intersecting recessed cones having apex angles of about 116° ± 10°, the apexes of said cones being spaced from each other such that the intersections of adjacent cones form sides of generally equilateral triangular cells, said sides being arranged along lattice lines extending at about 60° to each other, the intersections of said lattice lines being the lowermost points of said lower face, said sides being from about 0.17 to about 0.25 inch long.

2. The panel of claim 1 wherein the vertical distance from said apexes to a plane defined by said lowermost points is from 0.06 to 0.07 inch, and said panel has a total thickness from said upper face to said plane defined by said lowermost points of from 0.07 to 0.10 inch.

3. The panel of claim 2 wherein said panel is made of an acrylic material and has a weight of less than 5.4 ounces per square foot.

4. The panel of claim 3 wherein the thickness of material between said upper face and said apexes is at least 0.015 inch.

5. The panel of claim 1 wherein said panel is made of a thermoplastic material and has a weight of from 4.0 to 5.2 ounces per square foot.

6. The panel of claim 1 wherein said sides are from 0.18 to 0.20 inch long and said apex angle is from 114° to 120°.

7. The panel of claim 6 wherein said panel has a total thickness from said upper face to said plane defined by said lowermost points of from 0.07 to 0.10 inch.

8. The panel of claim 7 wherein said panel is made of a plastic and has a weight of from about 3.6 to about 5.8 ounces per square foot.

9. The panel of claim 8 wherein the plastic is acrylic.

10. The panel of claim 9 wherein said panel has a total thickness of from 0.08 to 0.09 inch and has a weight of from 4.4 to 5.2 ounces per square foot.

* * * * *